US008979717B2

(12) United States Patent
Glickstein et al.

(10) Patent No.: US 8,979,717 B2
(45) Date of Patent: Mar. 17, 2015

(54) CHIN-UP ASSEMBLIES

(75) Inventors: Jacob Glickstein, New Berlin, WI (US); Westin Nelson, Dayton, MN (US)

(73) Assignee: Brunswick Corporation, Lake Forest, IL (US)

( * ) Notice: Subject to any disclaimer, the term of this patent is extended or adjusted under 35 U.S.C. 154(b) by 237 days.

(21) Appl. No.: 13/492,271

(22) Filed: Jun. 8, 2012

(65) Prior Publication Data

US 2013/0172157 A1 Jul. 4, 2013

Related U.S. Application Data

(60) Provisional application No. 61/583,053, filed on Jan. 4, 2012.

(51) Int. Cl.

| | |
|---|---|
| ***A63B 21/068*** | (2006.01) |
| ***A63B 23/12*** | (2006.01) |
| ***A63B 21/00*** | (2006.01) |
| *A63B 7/00* | (2006.01) |
| *A63B 9/00* | (2006.01) |

(52) U.S. Cl.

CPC ..... *A63B 21/068* (2013.01); *A63B 23/1218* (2013.01); *A63B 2225/09* (2013.01); *A63B 21/00047* (2013.01); *A63B 7/00* (2013.01); *A63B 9/00* (2013.01)

USPC ..... 482/96; 482/143; 482/39

(58) Field of Classification Search

CPC ..... A63B 21/00079; A63B 21/00083; A63B 21/00094; A63B 21/00101; A63B 21/00112; A63B 21/00123; A63B 21/00127; A63B 21/14; A63B 21/1453; A63B 21/1465; A63B 21/1469; A63B 21/148; A63B 21/1492; A63B 21/1496; A63B 23/1218

USPC ..... 482/92–96

See application file for complete search history.

(56) References Cited

U.S. PATENT DOCUMENTS

| | | | | |
|---|---|---|---|---|
| 906,538 | A * | 12/1908 | Limoges | 482/92 |
| 1,840,170 | A * | 1/1932 | Neils et al. | 5/662 |
| 2,706,632 | A * | 4/1955 | Chandler | 482/94 |
| 4,743,018 | A * | 5/1988 | Eckler | 482/106 |
| 4,749,188 | A | 6/1988 | Montgomery | |
| 4,836,535 | A * | 6/1989 | Pearson | 482/101 |
| 5,588,942 | A | 12/1996 | Dillard | |
| 6,163,906 | A * | 12/2000 | Kay | 5/662 |
| 7,066,866 | B1 | 6/2006 | Mobley | |
| 7,108,636 | B1 | 9/2006 | Garcia | |
| 7,374,516 | B2 * | 5/2008 | Lundquist | 482/104 |
| 7,540,831 | B2 | 6/2009 | Hauser et al. | |

(Continued)

OTHER PUBLICATIONS

International Search Report for corresponding application PCT/US12/72162, having a mailing date of Apr. 23, 2013.

(Continued)

*Primary Examiner* — Stephen Crow
*Assistant Examiner* — Gary D Urbiel Goldner
(74) *Attorney, Agent, or Firm* — Andrus Intellectual Property Law LLP

(57) ABSTRACT

Chin-up assemblies have a mount, a suspension member spaced from the mount, at least one handle that is movable along the suspension member and pivotable with respect to the suspension member, and an arm coupled to the handle. Pivoting of the handle with respect to the suspension member couples the arm to the mount to thereby fix the position of the handle along the suspension member.

22 Claims, 6 Drawing Sheets

(56) References Cited

U.S. PATENT DOCUMENTS

| | | | | |
|---|---|---|---|---|
| 7,549,950 | B1 * | 6/2009 | Lundquist et al. | 482/101 |
| 7,569,004 | B2 | 8/2009 | Kolomeir | |
| 7,819,784 | B1 * | 10/2010 | Caswell et al. | 482/95 |
| 7,909,743 | B1 * | 3/2011 | Webber | 482/104 |
| 8,177,694 | B1 * | 5/2012 | Walker | 482/126 |
| 2007/0042878 | A1 * | 2/2007 | Lundquist et al. | 482/99 |
| 2010/0234193 | A1 | 9/2010 | Friedman et al. | |

OTHER PUBLICATIONS

International Preliminary Report on Patentability, PCT/US2012/072162, date of mailing Jul. 17, 2014.

* cited by examiner

CHIN-UP ASSEMBLIES

CROSS-REFERENCE TO RELATED APPLICATION

The present utility patent application relates to and claims priority of U.S. Provisional Patent Application Ser. No. 61/583,053, filed Jan. 4, 2012, the disclosure of which is incorporated herein by reference in entirety.

FIELD

The present disclosure relates to exercise equipment, and particularly to strength training equipment.

BACKGROUND

Dillard U.S. Pat. No. 5,588,942 discloses an adjustable exercise device. First and second rigid bars may be connected together by a support to form an elongated bar assembly having a longitudinal axis. A pair of hand grips are spaced from one another, and each hand grip includes a mounting portion which is freely pivotally supported on a bar for pivotal movement about pivot axis extending substantially perpendicular to the longitudinal axis of the bar assembly. A hand grip portion is supported on the mounting portion for swivel movement through 360 degrees about an axis of rotation disposed substantially perpendicular to and passing through the pivot axis at the point where the mounting portion is pivotally supported by the bar assembly. The swivel connection can be locked to prevent swiveling of the hand grip portion.

Mobley U.S. Pat. No. 7,066,866 discloses a chin-up bar assembly with sliding and swiveling handles. A chin up bar assembly is provided with a cross bar and a pair of handles slidably mounted on the cross bar. The handles are pivotally mounted for movement between locked and unlocked positions. When a user hangs from the handles, the handles automatically pivot to the locked position to frictionally engage the cross bar and prevent sliding movement of the handles along the cross bar. The handles also can be swiveled during use to exercise different muscles in the user's arms, chest and back.

Hauser et al U.S. Pat. No. 7,540,831 discloses a pull-up exercise assembly with rotatable handles and pivotable bar. An exercise assembly for performing a wide array of exercises including pull-ups and chin-ups is provided which includes a bar connected between rotatable swing arm assemblies. The swing arm assemblies extend along vertical faces of a frame and are adapted to rotate the bar from one position between the vertical faces to another position. The exercise assembly includes at least one handle assembly removably grasping the central bar and having a handle adapted to rotate 360 degrees during exercise.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In some examples, chin-up assemblies are provided having a mount; a suspension member spaced from the mount; at least one handle that is movable along the suspension member and pivotable with respect to the suspension member; and an arm coupled to the handle. Pivoting of the handle with respect to the suspension member couples the arm to the mount to thereby fix the position of the handle along the suspension member.

In other examples, a chin-up assembly extends in a lateral direction, a vertical direction that is perpendicular to the lateral direction and a transverse direction that is perpendicular to the lateral direction and perpendicular to the vertical direction. The chin-up assembly has a mount extending in the lateral direction; a suspension member extending in the lateral direction and spaced from the mount in the transverse direction; and a handle that is pivotable about the suspension member in the transverse direction towards and away from the mount. Pivoting the handle away from the mount frees the handle to move along the suspension member in the lateral direction. Pivoting the handle towards the mount locks the handle so as to prevent the handle from moving in the lateral direction.

BRIEF DESCRIPTION OF THE DRAWINGS

Examples of chin-up assemblies are described herein with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. Various equivalents, alternatives, and modifications are possible within the scope of the appended claims.

Figure 1:
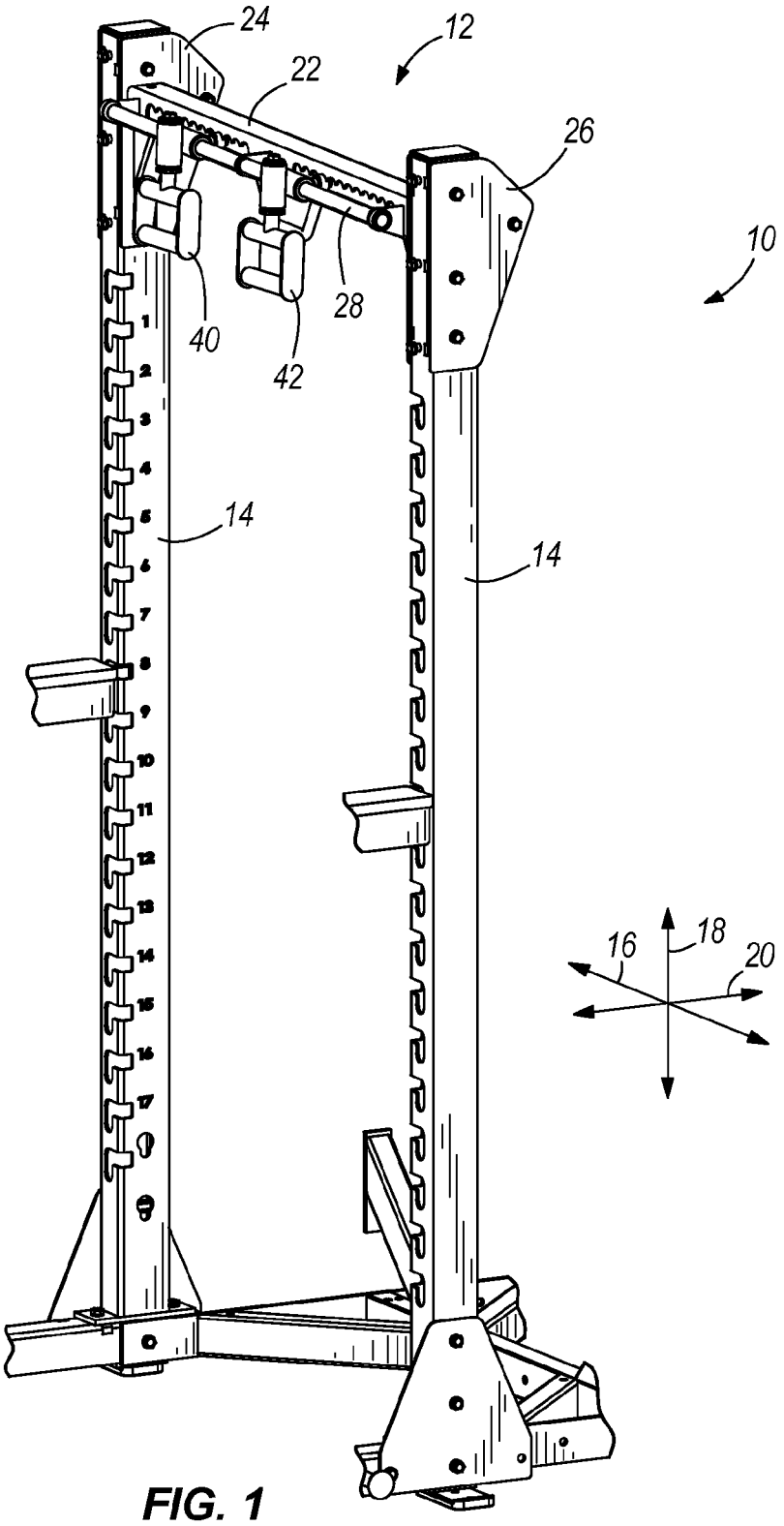
FIG. 1 depicts a frame for exercise equipment having a chin-up assembly.
Figure 2:
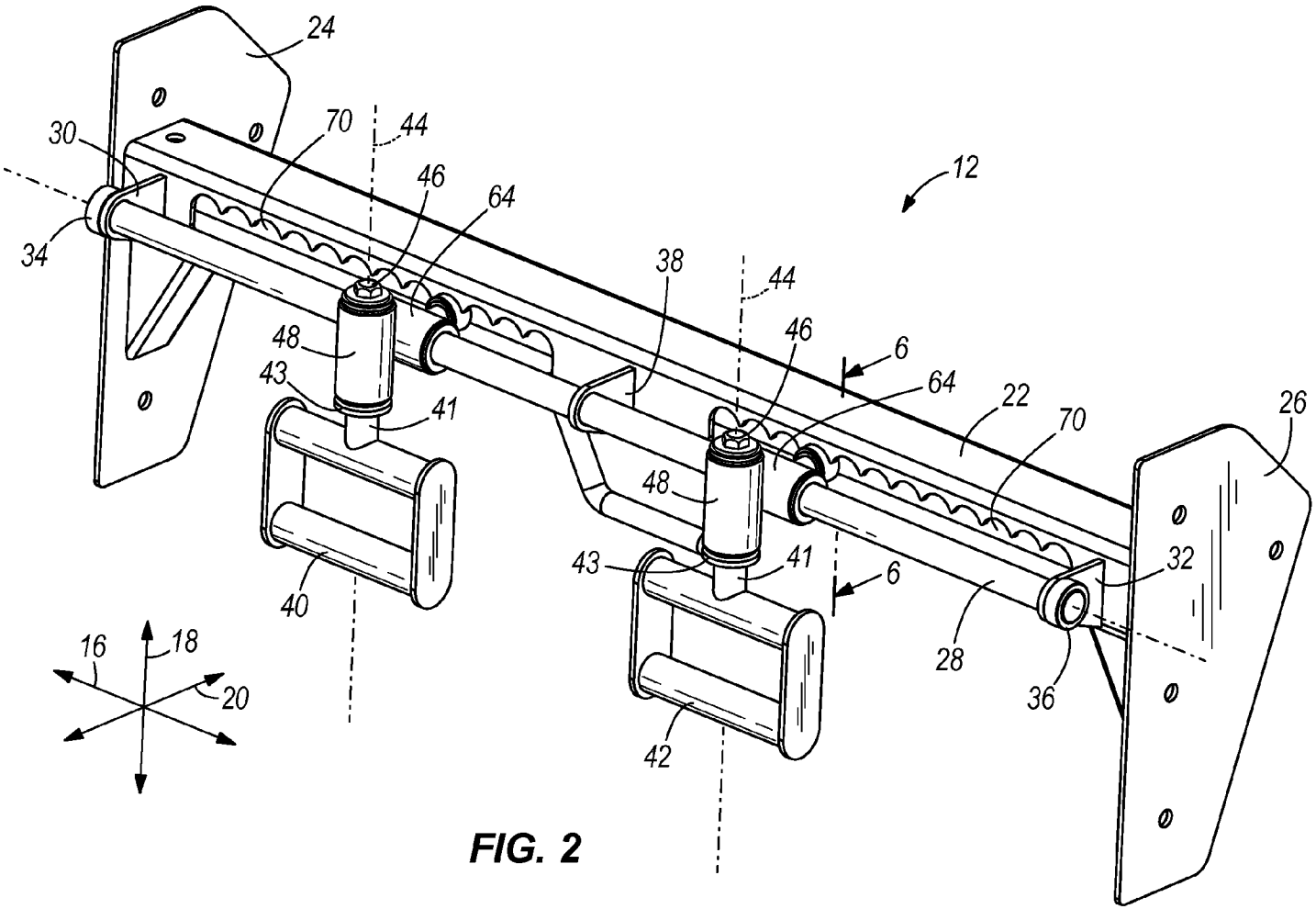
FIG. 2 is a perspective view of the chin-up assembly.

FIG. 1 depicts exercise equipment 10 including a chin-up assembly 12 mounted on two vertical support columns 14. The exercise equipment 10 and chin-up assembly 12 extend in a lateral direction 16, a vertical direction 18 that is perpendicular to the lateral direction 16 and a transverse direction 20 that is perpendicular to the lateral direction 16 and perpendicular to the vertical direction 18. As shown in FIG. 2, the chin-up assembly 12 includes a mount 22, which in the example shown is a cross bar supported between end supports 24, 26. The mount 22 in this example is a square tube; however it does not have to be a square tube and can, for example, comprise part of a wall surface or differently shaped member. The end supports 24, 26 are useful in the example shown for suspending the chin-up assembly 12 from the support columns 14; however these are optional structures that need not be included in the design. In the example shown, the end supports 24, 26 support the mount 22, and alternately support the mount 22 in a spaced apart position from a wall surface (not shown) to provide space for a user to perform chin-ups on the assembly 12.

A suspension member 28 is mounted to and spaced from the mount 22. In this example, the suspension member 28 includes a cylindrical bar that is fixed to the mount 22 by end brackets 30, 32. Opposing ends of the suspension member 28 are fixed to the end brackets 30, 32 by end pieces 34, 36. The suspension member 28 is inserted through holes in the end brackets 30, 32 and the end pieces 34, 36 are fastened to the opposing ends of the suspension member 28 via, for example, set screws 29. A center bracket 38 supports the middle of the suspension member 28, providing additional strength and stability.

Figure 3:
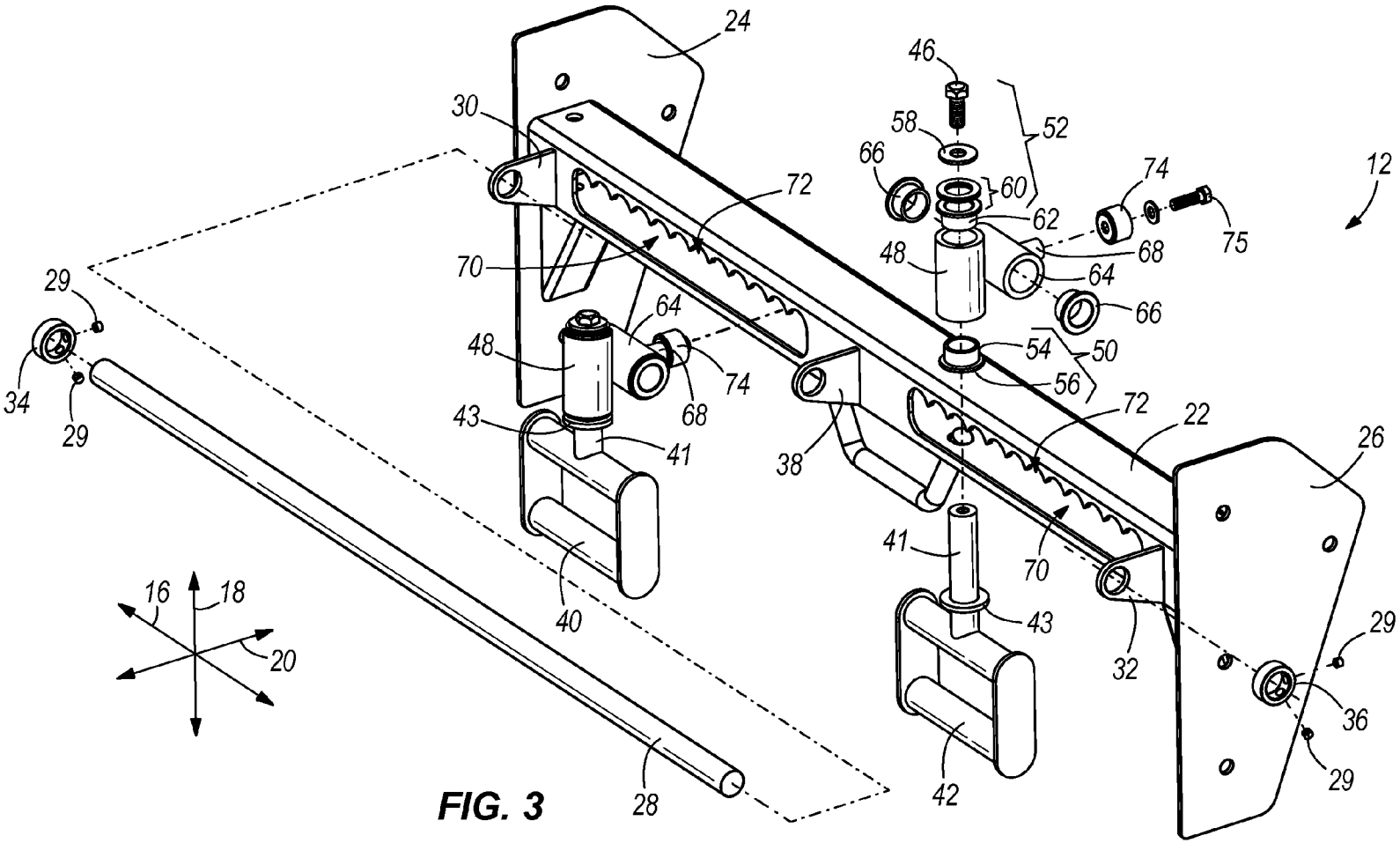
FIG. 3 is an exploded view of the chin-up assembly.

A pair of handles 40, 42 is connected to and laterally movable back and forth along the suspension member 28. Each handle 40, 42 is rotatable in 360 degrees about a vertical axis 44 extending in the vertical direction 48. In this example, each handle 40, 42 has a shank 41 that is connected by a bolt 46 to a sleeve 48 that extends along the noted vertical axis 44. A flange 43 is provided on the shank 41 below the sleeve 48. Referring to FIG. 3, lower and upper connection assemblies 50, 52 are provided on the ends of the sleeve 48 for facilitating the noted 360 degree rotation. The exact configuration of these assemblies 50, 52 can vary. In one example, the lower connection assembly 50 can include a bronze bushing 54 that is stacked on a washer 56 that is welded to the shaft of the respective handle 40, 42. The upper connection assembly 52 can include a fender washer 58 stacked on top of a thrust bearing assembly 60, which can include in series, a race, needle bearing, and race. The thrust bearing assembly 60 can be stacked on top of a bronze bushing 62, which in turn can be stacked on the upper end of the sleeve 48. The assemblies 50, 52 facilitate the noted 360 degree rotation of handles 30, 32 about the noted vertical axis 44. As noted above, the exact configuration of the assemblies 50, 52 can vary from that which is shown and described.

Sleeves 64 are provided on the suspension member 22 and are slidable along and rotatable about the suspension member 28. Each sleeve 64 is fixedly coupled to a respective sleeve 48, such that the respective handle 40, 42 rotates with and slides with the sleeve 64. Each sleeve 64 can have bronze bushings 66 at its ends, which facilitate easier sliding and rotating movement with respect to the suspension member 28. Sleeves 48, 64 can be fixedly connected together, for example by welding. In the example shown, the handles 40, 42 extend transversely vertically downwardly with respect to the respective sleeves 64.

An arm 68 radially extends in the transverse direction from the sleeve 64 into a recess 70 in the mount 22. In the example shown, the recess 70 defines a plurality of cut outs 72 that are spaced along the mount 22 so as to define fixable positions for the handle 40, 42, along the suspension member 22, as will be described herein below. The cut outs 72 in the plurality can be scallop-shaped. The length of the arm 68 is sized so that its free end is selectively engageable with the respective scallop-shaped cut outs 72. In this example, the arm 68 defines a cam follower 74 for residing in the scallop-shaped cut outs 72. The cam follower 74 can include a roller bearing that is rollable with respect to the arm 68 and connected thereto via bolt 75.

Figure 4:
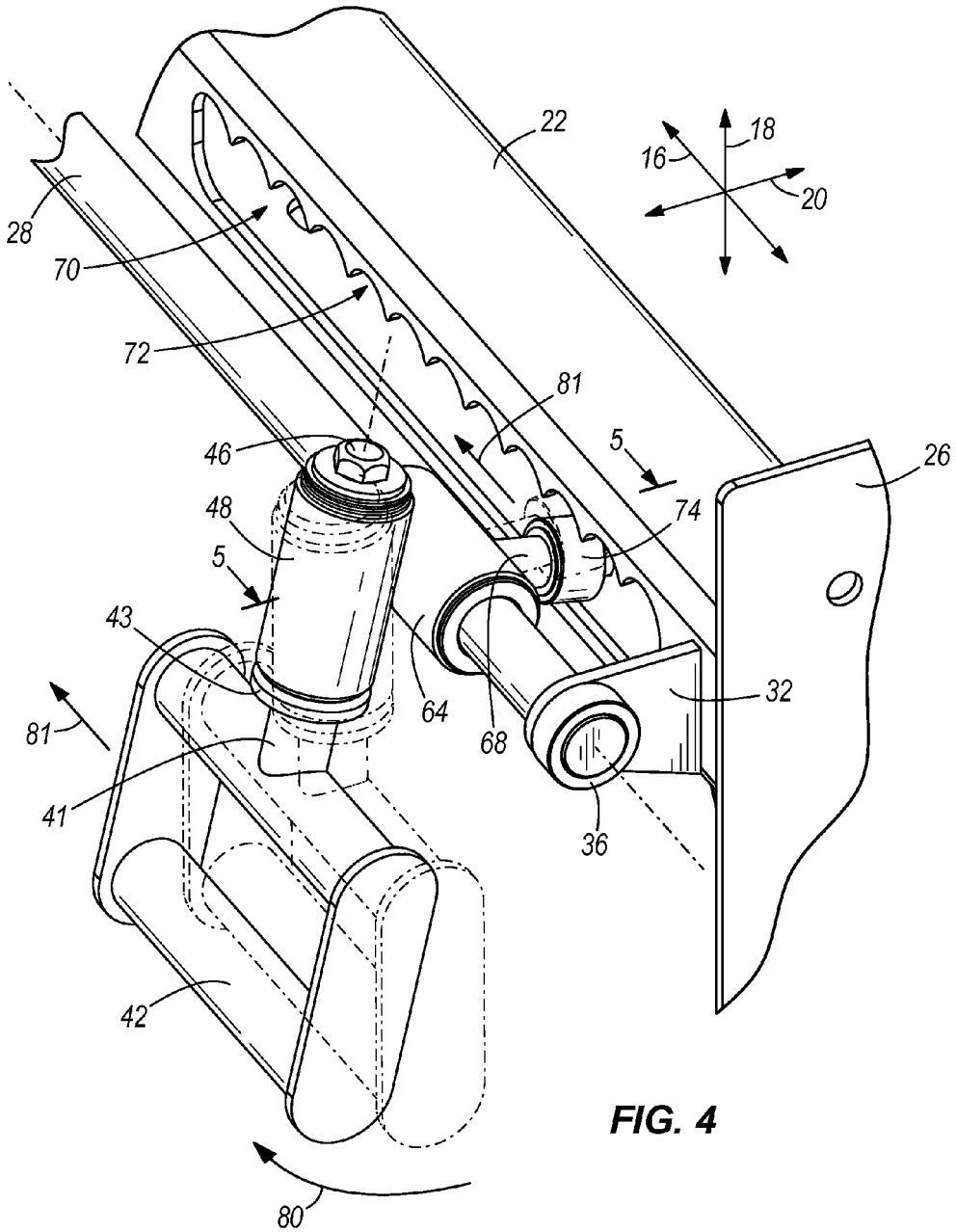
FIG. 4 is a partial view of the chin-up assembly showing a handle that is movable along and pivotable with respect to a suspension member and mount.
Figure 5:
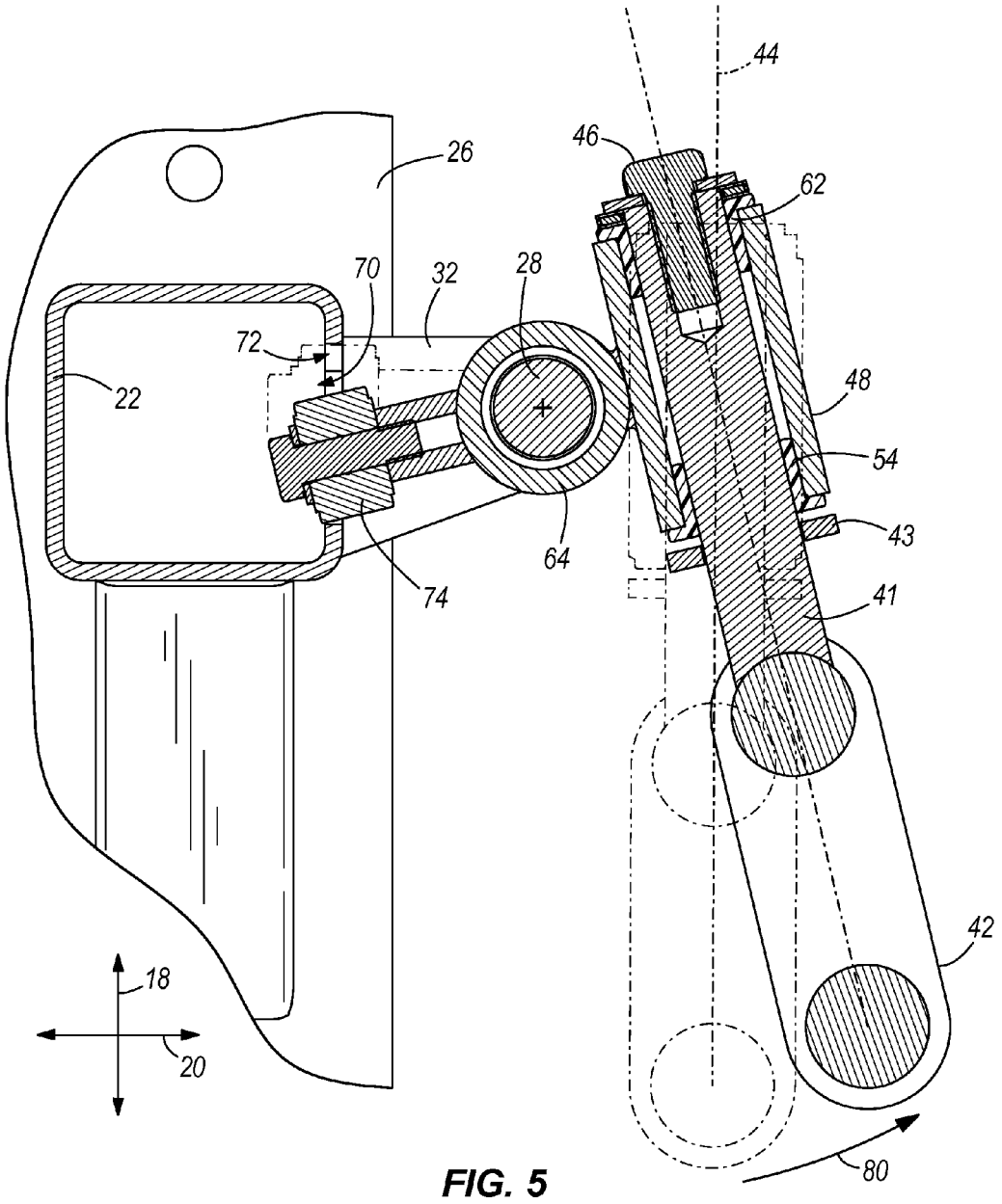
FIG. 5 is a view of Section 5-5 taken in FIG. 4.
Figure 6:
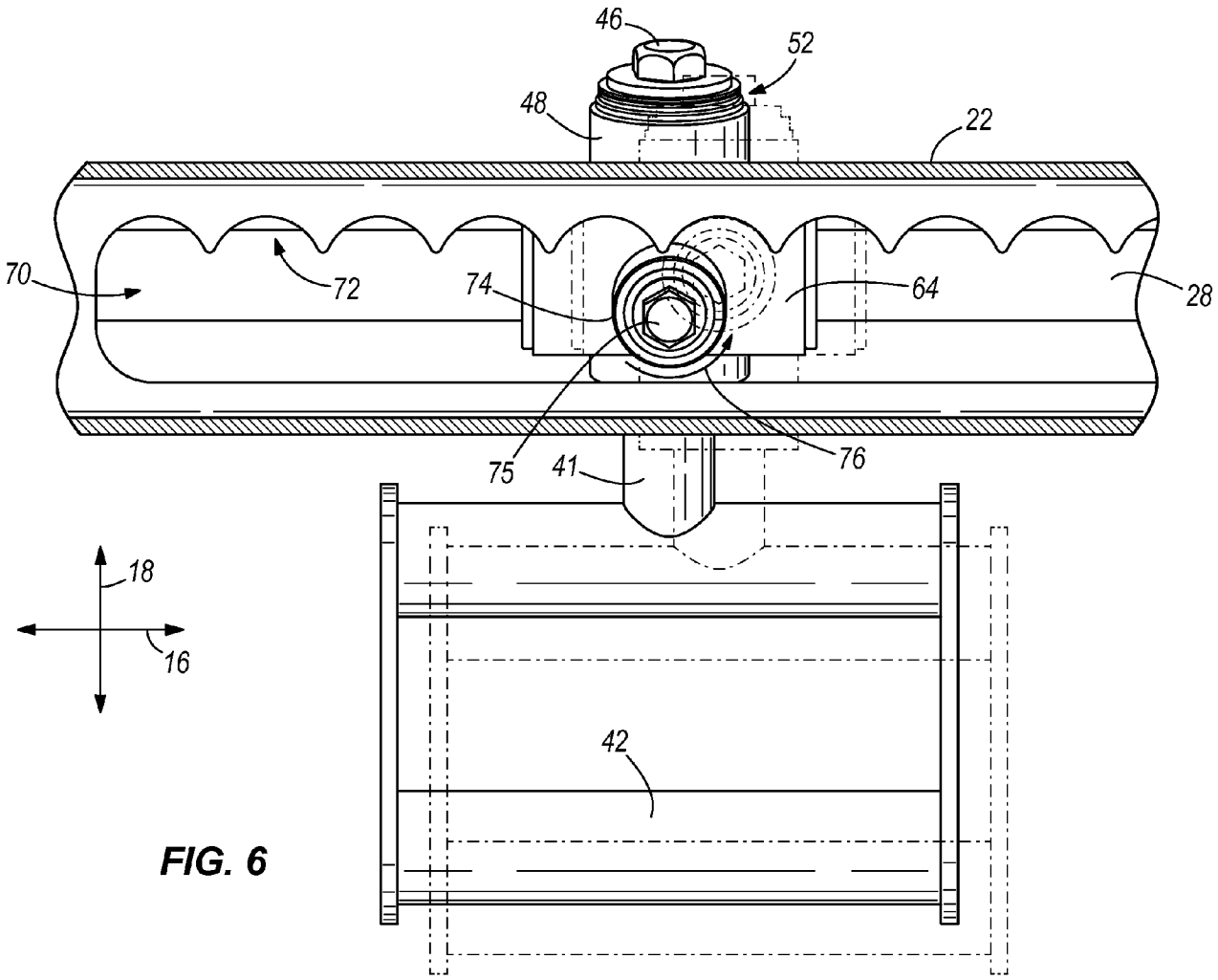
FIG. 6 is a view of Section 6-6 taken in FIG. 2.

Referring to FIGS. 4-6, the handle 40, 42 and sleeve 48 are coupled to the sleeve 64 and arm 68 such that the weight of the handle 40, 42 normally cams the respective sleeve 64 and arm 68 towards the mount 22, causing the cam follower 74 of the arm 68 to press against one of the cut outs 72 in the recess 70 of the mount 22. The weight of the handles 40, 42, sleeve 48 and noted assemblies 50, 52 can cam the arm 68 towards the mount 22 and into a respective cut out 72, to thereby fix the position of the handle 40, 42 into the cut out 72 and with respect to the suspension member 28. In use, the user applying downward force to the respective handle 40, 42, by for example pulling on or hanging from the handle 40, 42 can further cam the arm 68 towards the mount 22 to thereby more firmly fix the axial position of the handle 40, 42 with respect to the suspension member 28. Thus, when the user grasps the handles 40, 42 and suspends himself or herself from the handles 40, 42, the users weight pulls down on the handles 40, 42 and rotates the sleeve 64 about the suspension member 28, thus causing the arm 68 to move upwardly in the vertical direction 18. This causes the cam follower 74 of the arm 68 to press against one of the cut outs 72 in the recess 70 of the mount 22.

Referring to FIG. 6, if the cam follower 74 is aligned with a peak 78 between two of the respective cut outs 72 at the time when the user pulls down on the handles 40, 42 in the vertical direction 18, the rolling ability of the cam follower 74 will cause the arm 68 to move laterally off of the peak 78 (in either direction) and then upwardly into one or the other of the respective cut outs 72. See Arrow 76.

The lateral positions of the respective handles 40, 42 can be adjusted by pivoting the handles 40, 42 with respect to the vertical direction 18 and moving the respective handle 40, 42 in the lateral direction 16. When the user lifts the handles 40, 42 (see arrow 80 in FIG. 5), the cam follower 74 of the arm 68 can disengage with the cut out 72 in the recess 70 and thus move laterally and freely in either direction along the length of the recess 70 in the lateral direction (see Arrows 81).

By providing the user with handles 40, 42 that rotate, the user has the ability to work more muscles with each pull-up, therefore becoming a more efficient pull-up. Further, each handle 40, 42 can be incrementally freely laterally moved along the suspension member 28 (e.g. after the user lifts the handles 40, 42 in the direction of arrow 80). When the user applies weight to the handles 40, 42, the handles 40, 42 will effectively lock into place and prevent movement laterally, but still allow free rotation of the handles 40, 42. Subsequently, the handles 40, 42 will freely move laterally when the user's weight is no longer applied to the handles 40, 42 and the user lifts the handles 40, 42 in the direction of arrow 80. When no weight is applied to the handles 40, 42 and the handles 40, 42 are lifted upwardly in the direction of arrow 80, there is enough room in the recess 70 beneath the cut outs 72 that allows the arm 68 to move laterally and freely to allow for the noted adjustment. The handles 40, 42 can freely rotate the noted 360 degrees about the vertical axis 44, which in part is assisted by the noted thrust washers to prevent friction between the handle components. Thus, in this example, the handles 40, 42 can rotate freely and smoothly about the vertical axis 44 regardless of whether the user is hanging from the handles 40, 42 or if no weight is being applied.

The present disclosure thus provides chin-up assemblies 12 having a suspension member 28 spaced from a mount 22. At least one handle 40, 42 is movable along the suspension member 28 and pivotable with respect to the suspension member 28. An arm 68 is coupled to the handle 40, 42 via the sleeves 48, 64. Pivoting of the handle 40, 42 with respect to the suspension member 28 couples the arm 68 to the mount 22 by engaging the cam follower 74 with a cut out 72 in the recess 70 of the mount 22, to thereby fix the position of the handle 40, 42 along the suspension member 28 in the noted lateral direction 16. In the particular example shown and described, the mount 22 includes a cross bar that is supported between two end supports 24, 26 and defines a recess 70 into which the arm 68 extends. The recess has the noted plurality of cut outs 72 that are laterally spaced apart along the mount 22 and define fixable positions for the arm 68, and thus the handles 40, 42. The cut outs 72 in the plurality are scallop-shaped and the arm 68 fits into the cut outs 72. The rolling cam follower 74 on the arm 68 fits in the cut outs 72. As discussed, the rolling cam follower 74 laterally rolls off of a peak 78 located between adjacent cut outs 72 in the plurality when the handle 40, 42 is pivoted with respect to the suspension member 28.

Although only a few examples have been described in detail above, those skilled in the art will readily appreciate that many modifications are possible in the examples without materially departing from this invention. Accordingly, all such modifications are intended to be included within the scope of this disclosure as defined in the following claims. In the claims, means plus function clauses are intended to cover the structures described herein as performing the recited function and not only structural equivalents, but also equivalent structures. Thus, although a nail and a screw may not be structural equivalents in that a nail employs a cylindrical surface to secure wooden parts together, and whereas a screw employs a helical surface, in the environment of fastening wooden parts, a nail and a screw may be equivalent structures. It is the express intention of the Applicant not to invoke 35 U.S.C. §112, paragraph 6, for any limitations of any of the claims herein, except for those in which the claim expressly uses the words "means for" together with an associated function.

What is claimed is:

1. A chin-up assembly that extends in a lateral direction, a vertical direction that is perpendicular to the lateral direction and a transverse direction that is perpendicular to the lateral direction and perpendicular to the vertical direction, the chin-up assembly comprising:

a mount extending in the lateral direction;

a suspension member extending in the lateral direction, spaced apart from the mount in the transverse direction, whereby a gap exists between the suspension member and the mount in the transverse direction; and a handle that is pivotable about the suspension member in the transverse direction towards and away from the mount;

wherein the mount and suspension member are fixed in place with respect to each other;

wherein pivoting the handle away from the mount in the transverse direction frees the handle to move along, the suspension member in the lateral direction and wherein pivoting the handle towards the mount in the transverse direction locks the handle so as to prevent the handle from moving in the lateral direction.

2. The chin-up assembly according to claim 1, wherein gravity causes the handle to pivot towards the mount so as to lock the handle.

3. The chin-up assembly according to claim 2, comprising an aim coupled to the handle and extending towards the mount in the transverse direction, wherein pivoting the handle away from the mount frees the arm from the mount and wherein pivoting the handle towards the mount engages the arm with the mount.

4. The chin-up assembly according to claim 3, wherein the mount defines a recess into which the arm extends.

5. The chin-up assembly according to claim 4, wherein the recess has a plurality of cut-outs that are laterally spaced apart along the mount and define fixable positions for the arm.

6. The chin-up assembly according to 5, comprising a rolling cam follower on the arm, wherein the rolling cam follower fits in the plurality of cut-outs.

7. The chin-up assembly according to claim 6, wherein the rolling cam follower laterally rolls off of a peak located between adjacent cut-outs in the plurality of cut-outs when the handle is pivoted with respect to the suspension member.

8. The chin-up assembly according to claim 3, wherein the suspension member comprises a bar.

9. The chin-up assembly according to claim 8, comprising a sleeve that is rotatable with respect to the bar and slideable along the bar.

10. The chin-up assembly according to claim 9, wherein the arm radially outwardly extends from the sleeve such that when the sleeve rotates in one direction with respect to the bar, the arm is engaged with the mount and such that when the sleeve rotates in a second, opposite direction with respect to the bar, the arm is disengaged from the mount.

11. The chin-up assembly according to claim 1, wherein the handle is rotatable 360 degrees.

12. The chin-up assembly according to claim 11, wherein the handle is journalled in a sleeve.

13. The chin-up assembly according to claim 1, wherein the suspension member comprises a bar and wherein the handle is coupled to the bar by a sleeve that is slideable along the bar.

14. The chin-up assembly according to claim 13, wherein the handle is rotatable in 360 degrees.

15. The chin-up assembly according to claim 1, wherein the mount comprises a crossbar supported between end supports.

16. A chin-up assembly that extends in a lateral direction, a vertical direction that is perpendicular to the lateral direction and a transverse direction that is perpendicular to the lateral direction and perpendicular to the vertical direction, the chin-up assembly comprising:

a mount extending in the lateral direction;

a suspension member extending in the lateral direction and spaced apart from the mount in the transverse direction;

a handle that is pivotable about the suspension member in the transverse direction towards and away from the mount;

wherein pivoting the handle away from the mount frees the handle to move along the suspension member in the lateral direction and wherein pivoting the handle towards the mount locks the handle so as to prevent the handle from moving in the lateral direction;

wherein gravity causes the handle to pivot towards the mount so as to lock the handle;

an arm coupled to the handle and extending towards the mount in the transverse direction, wherein pivoting the handle away from the mount frees the arm from the mount and wherein pivoting the handle towards the mount engages the arm with the mount;

wherein the mount defines a plurality of cut-outs that receive a free end of the arm when the handle is pivoted towards the mount; and a cam follower on the free end of the arm;

wherein the cam follower comprises a roller bearing.

17. A chin-up assembly that extends in a lateral direction, a vertical direction that is perpendicular to the lateral direction and a transverse direction that is perpendicular to the lateral direction and perpendicular to the vertical direction, the chin-up assembly comprising:

a mount extending in the lateral direction;

a suspension member extending in the lateral direction, spaced apart from the mount in the transverse direction, whereby a gap exists between the suspension member and the mount in the transverse direction;

wherein the mount and suspension member are fixed in place with respect to each other;

a handle that is pivotable about the suspension member towards and away from the mount;

an arm coupled to the handle and extending towards the mount in the transverse direction;

wherein pivoting the handle downwardly towards the mount moves the arm upwardly into engagement with the mount so as to prevent the handle from moving in the lateral direction and wherein pivoting the handle upwardly away from the mount moves the arm downwardly out of engagement with the mount so as to allow the handle to move along the suspension member in the lateral direction.

18. The chin-up assembly according to claim 17, Wherein gravity causes the handle to pivot towards the mount so as to lock the handle with respect to the mount.

19. The chin-up assembly according to claim 17, wherein the mount defines a plurality of cut-outs that are oriented downwardly in the vertical direction so as to receive a free end of the arm when the handle is pivoted downwardly towards the mount.

20. A chin-up assembly that extends in a lateral direction, a vertical direction that is perpendicular to the lateral direction and a transverse direction that is perpendicular to the lateral direction and perpendicular to the vertical direction, the chin-up assembly comprising;

a mount extending in the lateral direction;

a suspension member extending in the lateral direction and spaced apart from the mount in the transverse direction;

a handle that is pivotable about the suspension member towards and away from the mount;

an arm coupled to the handle and extending towards the mount in the transverse direction;

wherein pivoting the handle downwardly towards the mount moves the arm upwardly into engagement with the mount so as to prevent the handle from moving in the lateral direction and wherein pivoting the handle upwardly away from the mount moves the arm downwardly out of engagement with the mount so as to allow the handle to move along the suspension member in the lateral direct;

wherein the mount defines a plurality of cut-outs that are oriented downwardly in the vertical direction so as to receive a free end of the arm when the handle is pivoted downwardly towards the mount; and a cam follower on the free end of the arm.

21. The chin-up assembly according to claim 20, wherein the cam follower comprises a roller bearing.

22. A chin-up assembly that extends in a lateral direction, a vertical direction that is perpendicular to the lateral direction and a transverse direction that is perpendicular to the lateral direction and perpendicular to the vertical direction, the chin-up assembly comprising:

a mount extending in the lateral direction;

a suspension member extending in the lateral direction and spaced apart from the mount in the transverse direction;

wherein the mount and suspension member are fixed in place with respect to each other;

a handle that is pivotable about the suspension member towards and away from the mount;

an arm coupled to the handle and extending towards the mount in the transverse direction;

wherein pivoting the handle downwardly towards the mount moves the arm upwardly into engagement with the mount so as to prevent the handle from moving in the lateral direction and wherein pivoting the handle upwardly away from the mount moves the arm downwardly out of engagement with the mount so as to allow the handle to move along the suspension member in the lateral direction;

wherein the suspension member comprises a bar and wherein the handle is coupled to the bar by a sleeve through which the bar extends, wherein the sleeve is slideabie along the bar, and wherein pivoting the handle downwardly in the vertical direction locks the handle so as to prevent the handle from moving in the lateral direction.

* * * * *

UNITED STATES PATENT AND TRADEMARK OFFICE

CERTIFICATE OF CORRECTION

PATENT NO. : 8,979,717 B2
APPLICATION NO. : 13/492271
DATED : March 17, 2015
INVENTOR(S) : Jacob Glickenstein and Westin Nelson It is certified that error appears in the above-identified patent and that said Letters Patent is hereby corrected as shown below:

In the Claims

In Claim 3, Column 5, Line 49: “aim” should instead read “arm”.

In Claim 18, Column 7, Line 9: “Wherein” should instead read “wherein”.

In Claim 20, Column 7, Line 37: “direct” should instead read “direction”.

In Claim 22, Column 8, Line 33: “slideabie” should instead read “slideable”.

Signed and Sealed this
Thirtieth Day of June, 2015

Michelle K. Lee

Michelle K. Lee
*Director of the United States Patent and Trademark Office*